166-250 SR
FIP9011 XR 4,158,957

United States Patent [19]
Deans et al.

[11] 4,158,957
[45] * Jun. 26, 1979

[54] METHOD FOR DETERMINING THE FLUID SATURATION OF AN IMMOBILE PHASE IN A RESERVOIR

[75] Inventors: Harry A. Deans; James R. Bragg, both of Houston, Tex.

[73] Assignee: Exxon Production Research Company, Houston, Tex.

[ * ] Notice: The portion of the term of this patent subsequent to May 23, 1995, has been disclaimed.

[21] Appl. No.: 878,211

[22] Filed: Feb. 16, 1978

Related U.S. Application Data

[63] Continuation-in-part of Ser. No. 756,150, Jan. 3, 1977, Pat. No. 4,090,398, which is a continuation-in-part of Ser. No. 647,223, Jan. 7, 1976, abandoned.

[51] Int. Cl.[2] ..... E21B 43/22
[52] U.S. Cl. ..... 73/19; 166/250
[58] Field of Search ..... 73/19, 23, 61 R; 23/230 EP; 166/250, 252

[56] References Cited

U.S. PATENT DOCUMENTS

| | | | |
|---|---|---|---|
| 3,590,923 | 7/1971 | Cooke | 166/252 |
| 3,685,345 | 8/1972 | Wise | 73/19 |
| 3,690,167 | 9/1972 | Chase et al. | 23/230 EP |
| 3,847,548 | 11/1974 | Keller et al. | 166/252 |
| 3,856,468 | 12/1974 | Keller et al. | 166/252 |

*Primary Examiner*—Stephen A. Kreitman
*Attorney, Agent, or Firm*—Michael A. Nametz; George E. Glober

[57] ABSTRACT

A method is disclosed for determining the relative amounts of two fluid phases in a subterranean formation, one phase being mobile and the other being substantially immobile. A sweep fluid which is substantially free of the immobile fluid is injected into the formation by means of a well in an amount such that a measurable first portion of the sweep fluid in the formation adjacent the injection well remains unsaturated with the immobile fluid, and a second portion adjacent the first portion becomes saturated. The sweep fluid is then produced from the formation, preferably by means of the injection well. The concentration of immobile fluid dissolved in the produced sweep fluid is measured as a function of volume produced to determine the volumes of the two sweep fluid portions; these volumes are then used to calculate the relative amounts of the two fluid phases in the formation.

7 Claims, 1 Drawing Figure

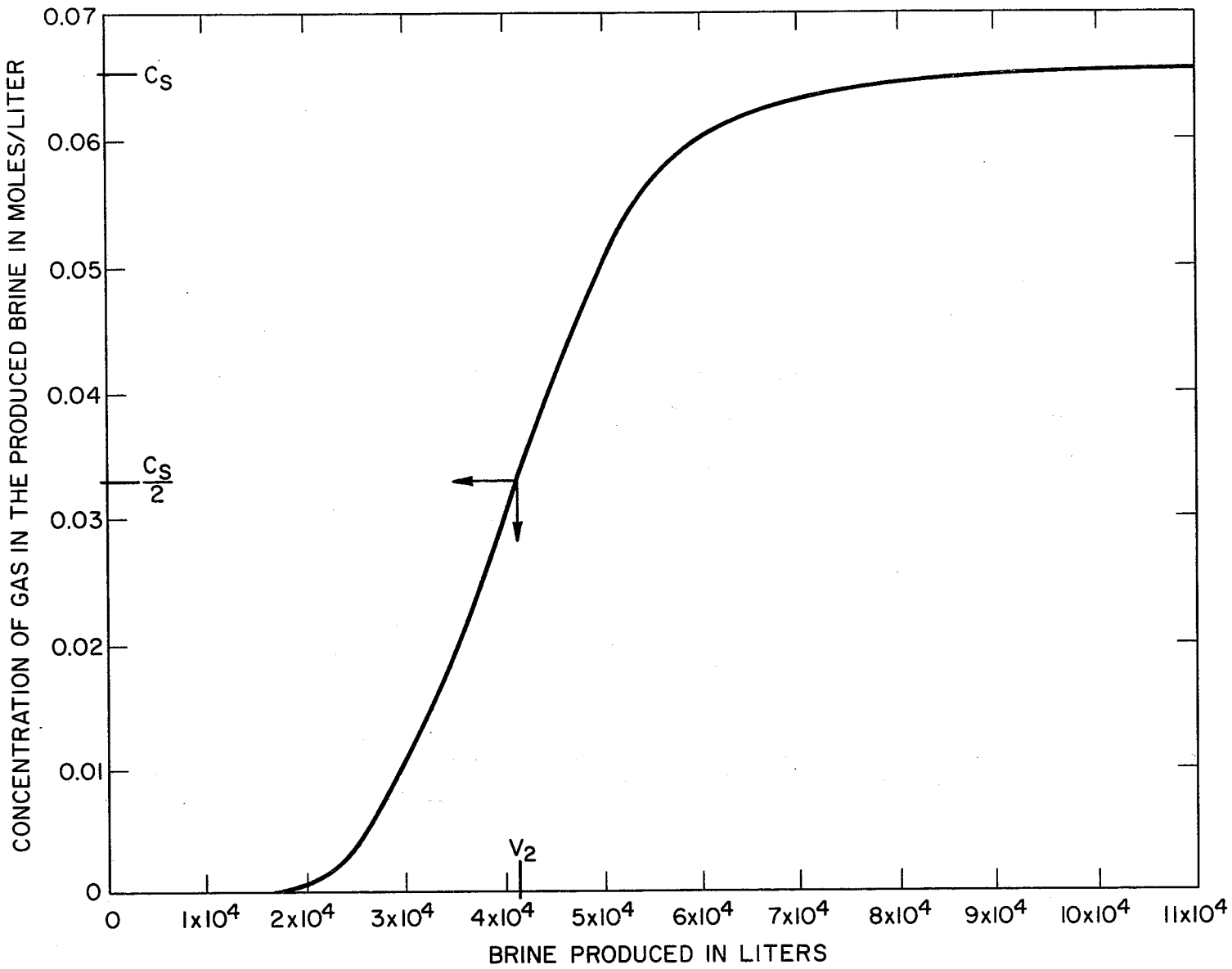
CONCENTRATION OF GAS IN THE PRODUCED BRINE IN MOLES/LITER
0.07
0.06
0.05
0.04
0.03
0.02
0.01
0
$C_S$
$\frac{C_S}{2}$
0
1x10^4
2x10^4
3x10^4
4x10^4
5x10^4
6x10^4
7x10^4
8x10^4
9x10^4
10x10^4
11x10^4
$V_2$
BRINE PRODUCED IN LITERS

METHOD FOR DETERMINING THE FLUID SATURATION OF AN IMMOBILE PHASE IN A RESERVOIR

CROSS-REFERENCE TO RELATED APPLICATION

This application is a Continuation-In-Part of U.S. Pat. application Ser. No. 756,150, filed Jan. 3, 1977, which issued as U.S. Pat. No. 4,090,398 on May 23, 1978, which is a Continuation-In-Part of U.S. Pat. application Ser. No. 647,223, filed Jan. 7, 1976, now abandoned.

BACKGROUND OF THE INVENTION

1. Field of the Invention

This invention relates to a process utilizing a well or wells and includes the steps of testing or measuring formation fluids. More specifically, this invention relates to a method for determining the fluid saturations of an immobile fluid phase and at least one mobile fluid phase in a subterranean reservoir.

2. Description of the Prior Art

A typical oil-productive formation is a stratum of rock containing tiny interconnected pore spaces which are saturated with oil, water and gas. Knowledge of the relative amounts of these fluids in the formation is indispensable to proper and efficient production of the formation oil. When a formation is first drilled, it is necessary to know the original oil saturation to intelligently plan the future exploitation of the field. In tertiary recovery techniques, such as in solvent flooding, the quantity of oil present in the formation will often dictate the most efficient manner of conducting such an operation.

It is also desirable to know the gas saturation in a formation which is flooded by water or oil. As gas is withdrawn from a formation containing gas and at least one other mobile liquid such as formation brine or crude oil, the mobile liquid replaces the space formerly occupied by the produced gas. Laboratory and field tests have shown, however, that large quantities of gas remain trapped in the formation. This unproduced gas represents the natural gas saturation which is unable to flow because there is no longer any permeability to gas due to the gas-water saturation relationship. Once the formation is filled with brine or oil, from one-tenth to one-half of the initial gas volume is potentially lost as a residual phase. It is generally desirable, therefore, to know the residual gas saturation in the portion of the formation flooded by water to estimate the recoverable gas in the unflooded portion of the formation.

There are several methods which are currently used to obtain the fluid saturation of a formation. Coring, one technique used for acquiring this information, is a direct sampling of the formation rock and liquids. For example, a small segment of the formation rock saturated with fluids is cored from the formation and removed to the earth's surface where its fluid saturation can be analyzed. This method, however, is susceptible to the faults of the sampling technique; thus, a sample taken may or may not be representative of the formation as a whole. Also, there is a genuine possibility that the coring process itself may change the fluid saturation of the extracted core. For example, in the coring process the fluid pressure may vary from reservoir conditions and this may cause the gas saturation to change. Moreover, coring can only be employed in newly drilled wells or open hole completions. In the vast majority of wells casing is set through the gas-bearing formation when the well is initially completed. Core samples, therefore, cannot subsequently be obtained from such a well. Finally, coring by its very nature only investigates the properties of the formation rock and fluids in the immediate vicinity of the wellbore.

Another approach for obtaining reservoir fluid saturations is by logging techniques. These techniques also investigate formation rock and fluid properties for only a short distance beyond the wellbore. These techniques study the rock fluid system as an entity; it is often difficult by this approach to differentiate between the properties of the rock and its fluids.

Material balance calculations based on production history are another approach to the problem. Estimates of fluid saturation acquired by this method are subjected to even more variables than coring or logging. The technique requires a knowledge of initial fluid saturation of a formation by some other method and knowledge of the source of the recovered fluid.

More recent methods for determining fluid saturation in a subterranean formation are concerned with injection and production of trace chemicals into and out of the formation. For example, as proposed in U.S. Pat. No. 3,590,923 issued July 6, 1971 to C. E. Cooke, Jr., a carrier fluid containing at least two tracers having different partition coefficients between the immobile fluid and the aqueous fluid containing the tracers is injected into one location in the formation and produced from another. Due to the different partition coefficients of the tracers, they will be chromatographically separated as they pass through the formation, and this chromatographic separation is a function of the saturation of the immobile fluid phase. In another example, as suggested in U.S. Pat. No. 3,623,842 issued Nov. 30, 1971 to H. A. Deans, a carrier fluid containing a reactive chemical substance is injected into the formation through a well. The carrier fluid reactant solution is displaced into the formation, and the well is shut-in to permit the reactant to undergo a chemical change to produce additional tracer materials having different partition coefficients. When the well is produced, the tracers having different partition coefficients are chromatographically separated, and the degree of separation may be used to determine the residual fluid saturation in the formation. In still another example, as proposed in U.S. Pat. No. 3,856,468 issued Dec. 24, 1974 to Keller, residual gas saturation in a subterranean formation containing at least one mobile fluid phase can be determined. In this method, brine which is miscible with the formation brine and contains low concentrations of at least two chemical substances is injected into the formation through a well and displaced into the formation away from the well. One of these substances is a precursor that reacts in the formation to form two substances. One substance is a tracer material that partitions between the gas phase and brine differently than the precursor and the other substance is a substantially nonreactive tracer material. The well is shut-in for a period sufficient for the precursor to react, and the well thereafter is returned to production. The produced fluids are analyzed for the presence of the tracer materials and the gas saturation of the formation is determined by applying principles of chromatography. However, the use of trace chemicals to determine the residual gas saturation is subject to certain drawbacks. A principal problem with these methods is that the chromatographic separation of the trace chemicals due to their solubility in the gaseous phase can be so small that the measured results can be extremely difficult to analyze.

SUMMARY OF THE INVENTION

In accordance with the teachings of this invention the fluid saturations of an immobile fluid phase and at least one mobile fluid phase is a subterranean reservoir formation are determined by injecting into the formation a measured volume of a sweep fluid unsaturated with the immobile fluid and having limited solubility for the immobile liquid. The sweep fluid is injected in an amount such that a portion of the sweep fluid in the formation remains unsaturated with the immobile fluid phase. The sweep fluid preferably contains a tracer to aid in analyzing the flow behavior of the sweep fluid within the formation. As the sweep fluid flows radially away from the wellbore it dissolves immobile fluid and reduces the immobile fluid saturation. Preferably the flow is reversed and the sweep fluid is produced through the injection well in an amount sufficient to determine the volume of sweep fluid substantially unsaturated with immobile fluid. Alternatively, fluid may be injected into one well and the injected fluid produced from a second well. By measuring the concentration of the immobile fluid dissolved in the produced fluid and by measuring the produced fluid volume, the relative proportions of the immobile and mobile fluids in the formation can be determined.

Objects and features of the invention not apparent from the above discussion will become evident upon consideration of the following description of the invention taken in connection with the accompanying drawing.

BRIEF DESCRIPTION OF THE DRAWING

The FIGURE is a graph of the concentration of dissolved gas in the produced water, moles/liter, as a function of liters of water produced.

DESCRIPTION OF THE PREFERRED EMBODIMENT

It will be apparent from this disclosure that the method of this invention has broad applicability for determining the relative amounts of two existing fluid phases, one mobile and the other essentially immobile. The method may be employed to determine the connate water saturation in an oil and gas reservoir. The method may be used to determine the residual gas saturation in a formation saturated with a liquid. The method may employ a single well with fluid injected into the formation and fluid withdrawn from the same well or the method may employ two wells with fluid injected through one well and fluid produced through an adjacent well.

The general method of the present invention is practiced as follows. A sweep fluid having a limited solubility for the immobile fluid is selected for injection into the formation. A measured volume of sweep fluid which is unsaturated with the immobile fluid is then injected into the formation. A sweep fluid front is thereby created in the formation. The volume of sweep fluid is selected so that upon injection, two characteristic fluid volumes will exist in the formation between the front and the injection well. The first fluid volume (nearest the front) will be substantially saturated with the immobile fluid, while the second fluid volume (nearest the injection well) will be unsaturated.

Thereafter, the sweep fluid is produced, preferably by means of the injection well, such that the volume of sweep fluid which has remained unsaturated with the immobile fluid (i.e., the second fluid volume) can be determined. In practice, this is accomplished by measuring the concentration of immobile fluid in the sweep fluid as a function of produced volume. The point at which an appreciable increase in the concentration of the immobile fluid is detected characterizes the second fluid volume.

The saturation of immobile fluid in the reservoir ($S_{if}$) can then be determined according to the following equation:

$$S_{if}=(C_s/C_{if})\cdot(V_t-V_2/V_2) \quad \text{(Eq. 1)}$$

Where $S_{if}$=immobile fluid saturation, fraction of reservoir pore volume;

$C_2$=the amount of immobile fluid per unit volume of sweep fluid when the sweep fluid is saturated with the immobile fluid at reservoir temperature and pressure;

$C_{if}$=the amount of immobile fluid per unit volume of immobile fluid at reservoir temperature and pressure;

$V_t$=the total volume of sweep fluid injected into the reservoir (the first fluid volume plus the second fluid volume); and $V_2$=the second fluid volume.

The temperature and pressure of the subterranean formation will typically be known prior to the injection of the sweep fluid; this information may be obtained, however, at any convenient time by methods well known to those skilled in the art. Knowledge of reservoir temperature and pressure, along with immobile fluid composition, readily permits calculation of the concentration terms, $C_s$ and $C_{if}$, (often in terms of moles/liter or pounds per cubic foot) using simple laws of chemistry. The value of $V_t$ is known and the value of $V_2$ can be determined as described previously.

Preferably, the sweep fluid has substantially the same physical and chemical characteristics as the mobile fluid. In general, the volume of injected sweep fluid that is unsaturated with the immobile fluid ($V_2$) can often be determined before the production of sweep fluid which is saturated with the immobile fluid. For example, production of sweep fluid can be discontinued when sweep fluid having an immobile fluid concentration of one-half the concentration of the immobile fluid at saturation conditions are produced. At this point, the volume produced can be utilized as the value of $V_2$.

In particular, one of the many uses of this invention—determination of the residual gas saturation in a watered-out reservoir using one well—will be described in detail as a preferred embodiment. From this, one skilled in the art will readily appreciate and understand other embodiments of the method of the present invention.

In this particular embodiment, a subterranean reservoir containing residual natural gas and mobile water is penetrated by a well which has been drilled from the surface in a conventional manner. The well has been perforated to provide fluid communication between the interior of the well and the formation. The formation has an average thickness of 6.1 m and an average porosity of 30%. The formation temperature is 88° C. and the fluid pressure in the formation is 168 kg/cm$^2$.

The portion of the formation being tested is watered-out. When the well was initially completed the formation in the immediate vicinity of the well was gas producing. However, as gas was produced from the well and other wells higher in the formation, a strong natural water drive displaced the gas from the lower portion of the reservoir. At this point in time, no measurable quantities of gas are being produced from the well and the gas in the reservoir is essentially immobile. Knowledge of the residual gas saturation in the watered-out portion of the formation is important to estimate the gas reserves in the upper portion of the formation which has not been invaded by water. This gas saturation may be determined in the following manner.

A sweep fluid that is substantially free of dissolved gas is injected into the formation by means of the well. Brine previously produced from the subterranean formation is used. The use of brine will insure miscibility and compatibility with the formation liquid. 795 $m^3$ of brine are injected into the formation at a rate of 159 $m^3$ per day. The total injection period is 120 hours.

After the gas-free sweep fluid has been injected, the well is back-produced at the rate of 64 $m^3$ per day and the produced sweep fluid analyzed for the concentration of dissolved gas. The results of these gas concentration measurements are shown in the FIGURE. Production of brine continues until brine saturated with gas at reservoir conditions is produced.

The FIGURE graphically illustrates the concentration of gas in moles/liter in the produced brine (sweep fluid) as a function of volume of produced brine measured in liters. As can be seen from the FIGURE, about $1.6\times10^4$ liters of brine were produced before any gas was detected. After this volume was produced the gas concentration increased until about $9\times10^4$ liters had been produced. Thereafter, the gas concentration in the produced brine remained constant at 0.065 moles/liter. This concentration is the saturated gas concentration of the brine at the above stated reservoir temperature and pressure.

As will be described in greater detail hereinafter, the relative fluid saturation of the formation can be determined by relating two fluid volumes. The first volume is that volume of sweep fluid between the wellbore and the liquid front. The second volume is that volume of sweep fluid between the wellbore and the point in the formation where the gas concentration changes from initial unsaturated concentration to saturated concentration. Without the effects of dispersion and diffusion this concentration change is sharp and immediate. In actual practice, however, dispersion and diffusion cause this concentration change to be smeared.

These two volumes of sweep fluid between the injection well and the fluid front can be related to the saturation of gas in the formation. It is recognized, for example, that the ratio of these two volumes remains constant during the injection cycle assuming, of course, that the fluid saturations, reservoir temperature, and the fluid pressure in the reservoir remain constant.

The volume of sweep fluid between the injection well and the fluid front is readily determined by measuring the volume of sweep fluid injected into the formation. The volume of sweep fluid between the injection well and a second fluid front which corresponds to the location where the gas concentration in the sweep fluid abruptly changes from the gas concentration in the fluid as it first enters the formation to the gas concentration at saturation conditions may be determined by measuring the concentration of gas in the produced sweep fluid. The ability to measure the volume of fluid between the wellbore and the second front, which corresponds to the abrupt change in gas concentration, is based on the recognition that the gas concentration profile in the sweep fluid at the end of the injection cycle remains substantially the same as the liquid is produced. That is, the measured gas concentration profile as shown in the FIGURE substantially corresponds to the concentration profile in the brine at the end of the injection cycle. Referring to the FIGURE, $C_s$ is the concentration of gas dissolved in the sweep fluid when the sweep fluid is saturated with the gas at reservoir conditions. Since the front corresponding to the change in gas concentration between initial gas concentration and saturation gas concentration, $C_s$, is not sharp and distinct, a convenient method of determining the volume of sweep fluid, $V_2$, between the wellbore and the front is to measure the volume of liquid produced from the formation prior to detection of liquid containing gas at one-half the concentration of gas, $C_s/2$, in the brine at saturation conditions. Referring to the FIGURE, for the example previously described, the value of $V_2$, which corresponds to a detected gas concentration of $C_s/2$, is about $4.07\times10^4$ liters.

The fluid saturations of the formation can be determined from the results of this method using well known material balance principles which take into account mass transfer between a liquid phase and gas phase as the liquid phase flows through a porous medium containing immobile gas. For example, applying these material balance principles to the measures gas concentration, and the injected and produced sweep fluid volumes of the previously recited example, the residual gas saturation, $S_{gr}$, can be expressed as:

$$S_{gr}=(C_s/C_g)\cdot(V_1-V_2/V_2) \quad \text{(Eq. 2)}$$

Where $S_{gr}$=residual gas saturation, fraction of reservoir pore volume.

$C_s$=the concentration of gas dissolved in the sweep fluid when the sweep fluid is saturated with the gas at reservoir conditions moles/liters).

$C_g$=moles of residual gas per unit volume of residual gas at reservoir temperature and pressure (moles/-liters).

$V_1$=the total volume of sweep fluid injected into the reservoir (liters).

$V_2$=the volume of produced sweep fluid which corresponds to the volume of sweep fluid between the wellbore and the front where the gas concentration in the produced fluid changes from the original injected gas concentration to saturated gas concentration $C_s$ (liters).

The concentration of gas, $C_g$, in the residual gas phase at initial reservoir conditions is determined by using simple gas laws. In order to determine $C_g$ it is necessary to know the fluid pressure in the formation, the formation temperature and the composition of the gas in the formation. The compressibility factor, which may vary for each gas composition, is determined to be 0.95 for the gas in this example.

For the foregoing example the calculated value of $C_g$ is 6.14 moles/liter and the measured value of $C_s$ is 0.065 moles/liter. The value of $V_2$ is $4.07\times10^4$ liters and the total injected volume $V_1$ is $7.95\times10^5$ liters. It follows from Equation 2, therefore, that the gas saturation is 0.196 and the water saturation is 0.804. (It may be noted that Equation 2 is simply a more specific version of Equation 1).

In another embodiment of this invention, the connate water saturation of a reservoir can be determined. In this embodiment, a fluid which is substantially immiscible with formation water and which is substantially free of water is injected into the formation. The injected fluid may include liquids such as butyl alcohol, pentyl alcohol or other higher alkanols or gases such as flue gas, nitrogen or air. After the fluid is injected into the formation by means of a well in an amount such that a portion of the injected fluid in the formation remains unsaturated with water, at least a portion of the injected fluid is produced either through an adjacent well or through the same well used for injection. The water concentration in the produced liquid is measured. The connate water saturation can be determined by using material balance principles similar to the principles described above for determining gas saturation in reservoirs.

Preferably, a tracer is incorporated in the sweep fluid injected into the formation. The principal purpose for using a tracer is to aid in determining the fluid flow characteristics such as fluid drift and dispersion of the injected fluid. Any suitable tracer can be added to the injected fluid and the return profiles considered in calculating the residual fluid saturation. The chemical tracer is preferably detected and its concentration measured when the produced fluid is analyzed for the dissolved immobile fluid concentration. The tracer concentration profile may be used for determining when the total volume of fluid injected into the formation has been produced. Thus, knowledge of when the volume of injected fluid has been produced can be determined either by knowing the total injected fluid volume or by measuring the tracer concentration profile in the produced fluid and determining the injected fluid volume using general engineering principles.

While it is essential in this invention that the formation contain a mobile fluid, it is not essential that the formation contain an absolutely immobile fluid. The phraseology "immobile fluid" is employed for convenience and clarity and it should be understood that the immobile fluid may be capable of flowing to some extent.

Although the practice of this invention has been described above for a watered out portion of a gas formation, it is not necessary to the practice of this invention for the formation to be watered-out. For example, in a formation containing producible gas, liquid may be injected by means of a well into the portion of the formation to be tested. By injecting this liquid, the gas saturation in the formation around the wellbore will approach residual gas saturation. Sufficient fluid should, therefore, be injected into the formation so that the fluid injected in accordance with the practice of this invention will contact an immobile fluid.

The sweep fluid injected should preferably be substantially free of dissolved immobile fluid. This simplifies analysis of results. For obvious practical reasons the injected fluid should be capable of taking up immobile fluid from the formation, therefore, it must not be saturated with the fluid at reservoir conditions. If the injected sweep fluid contains dissolved immobile fluid it is essential in the practice of this invention that the immobile fluid concentration be known in order to determine the amount of the immobile fluid in the produced fluid that was absorbed from the formation.

Although the sweep fluid employed in the foregoing example was miscible with the formation's mobile fluid, these two fluids may be immiscible with each other. Analysis of the results, however, would be more complex if these two fluids are immiscible because it may be necessary to employ reservoir modeling techniques together with principles of chromatography to satisfactorily analyze the results. Therefore, the injected sweep fluid is preferably miscible or substantially soluble with the mobile fluid. The immobile fluid must have a limited solubility in the injected fluid in order that a saturated concentration of immobile fluid in the mobile fluid can be attained. Preferably, the sweep fluid is substantially insoluble in the immobile fluid.

The trace chemicals suitable for use in one embodiment of this invention can be selected from a wide category of known and available substances. In making such a selection the purpose of the trace chemical and the particular manner in which it is to be used should, of course, be kept in mind. As previously mentioned, the tracer in this invention is used only for material balance purposes and is not an essential feature of this invention. The chemical should be soluble in the sweep fluid and it should have little or no tendency to adsorb on or react with the matrix of the porous medium. It should also be essentially insoluble in the immobile fluid. It should, of course, be capable of detection by such means as chemical analysis or radiological techniques where a radioactive chemical is employed. Although it is not a requisite, the chemical can be capable of reacting while in the formation to produce another trace chemical. Preferably, the trace chemical should be inexpensive and readily available.

The concentration of the trace chemical in the injected fluid can be established by one of ordinary skill in the art using general engineering principles. Preferably, as a matter of economics, the concentration of the trace chemical in the sweep fluid ranged from about one-half to two percent by volume.

The injection and production rates of the fluids can be established by those skilled in the art by taking into account such factors as the reservoir conditions and injection and production facilities. The injection rate, however, should be sufficiently high so that the sweep fluid can move through the formation against fluid drift. On the other hand, the injection rate should not be so high that the formation will fracture. In the practice of this invention the injection rate is not a significant factor in the analysis of the results because the rate of immobile fluid adsorption by the sweep fluid is relatively independent of the sweep fluid flow rate. The production rate should not significantly change the formation fluid pressure. Therefore, the reduction of pressure during the producing cycle should not significantly affect the results of this invention. For example, referring to the above example for determining the gas saturation in a formation, as brine is removed from the reservoir it serves to reduce the pressure on the reservoir and cause a slight expansion of the residual gas. Once the residual gas expands, the gas saturation increases and some gas comes out of solution and tends to flow to the upper portion of the reservoir. These pressure effects, therefore, may cause the gas concentration profile in the produced liquid to differ slightly from the gas concentration profile in the liquid at the end of injection. However, these pressure effects can be taken into account in analyzing the results of this invention.

The volume of sweep fluid should be large enough to dissolve the immobile fluid in the formation adjacent the injection well. This is desirable in order to assure that at least a portion of the sweep fluid in the formation remains unsaturated with immobile fluid and that the first produced sweep fluid is not saturated with immobile fluid. If this first produced fluid was saturated with immobile fluid, the relative amounts of the two fluid phase in the formation could not be determined by the practice of this invention.

Various methods can be used to analyze the immobile fluid concentration in the produced sweep fluid. For example, this determination can be made at the wellhead by determining the quantity of immobile fluid and mobile fluid being produced. If the immobile fluid is gas, care should be taken to prevent fluctuation of the gas and liquid flow rates at the wellhead because such fluctuation may complicate analysis of the gas concentration in the produced liquid. A preferred method of determining the concentration of gas in the produced liquid is to measure the gas concentration in the liquid sampled in the wellbore adjacent to the formation. A downhole sampler of conventional design can be lowered periodically from the earth's surface into the wellbore to obtain samples for this analysis. Any conventional downhole sampler which eliminates pollution, loss, or alteration of the sample can be used. An example of a suitable downhole sampler is sold under the tradename Flopetrol bottom-hole sampler, type 04-05DB by Flopetrol of Vaux-le-penil, France. The concentration of gas and tracer in the produced carrier liquid can be analyzed in any conventional manner. For example, a subsurface sample obtained at reservoir pressure and temperature can be expanded into an apparatus such that the fluids are at atmospheric pressure and the relative amounts of gas and liquid measured at standard temperature and pressure. The concentration of trace chemicals may be detected in any conventional manner such as chromatographic techniques. Also, it is contemplated that the tracers may be radioactive isotopes and that their arrival times may be determined with radiological means.

As discussed above, this invention may be used to measure the residual natural gas concentration in a watered-out reservoir. Natural gas is a mixture of hydrocarbon gases with varying amounts of impurities. Hydrocarbon gases found in produced natural gas generally comprise methane, ethane, propane, butane, pentane, and to a lesser degree hexane, heptane, and octane. Since each of these gases may have a different solubility, the sweep fluid will dissolve each of these gases to a different extent. In most instances this does not present a serious problem since most of the natural gas is composed of methane. However, where a formation contains a mixture of gases in which chromatographic effects are significant, those such chromatographic effects should be taken into account in analyzing the results of this invention.

The technique of this invention has been illustrated by a method where a single well is used for injection and production. However, it should be obvious that a single well is not necessary. The sweep fluid which is substantially free of the immobile fluid can be injected through one well and withdrawn from another. If the sweep fluid is produced from a second well, a sufficient amount of the injected fluid must be injected into the formation such that a portion of the sweep fluid that is produced from the second well is unsaturated with immobile fluid. The concentration of the immobile fluid dissolved in the sweep fluid is measured at the second location and the relative amounts of the immobile and mobile fluids in the formation are determined. The single well technique is preferred, however, since shorter injection and production times can generally be employed by this method.

The principle of the invention and the best mode in which it is comtemplated to apply that principle have been described. It is to be understood that the foregoing is illustrative only and that other means and techniques can be employed without departing from the true scope of the invention defined in the following claims.

What we claim is:

1. A method of determining the relative amounts of two fluid phases existing in a subterranean reservoir formation having a known temperature and fluid pressure, one phase being mobile and the other phase essentially immobile, which comprises:

(a) selecting a sweep fluid having a limited solubility for said immobile fluid;

(b) injecting a measured volume of said sweep fluid which is unsaturated with said immobile fluid into said formation by means of a well such that a fluid front is created in said formation, the volume of said sweep fluid injected being selected such that a first and second fluid volumes exist between said front and said well, said first fluid volume being substantially saturated with said immobile fluid and said second fluid volume being unsaturated with said immobile fluid;

(c) determining said second fluid volume by producing said sweep fluid back through said well and measuring the concentration of said immobile fluid in said sweep fluid as a function of the volume produced, said second fluid volume being that volume at which an appreciable increase in the concentration of said immobile fluid is detected; whereby said second fluid volume is taken as the unknown $V_2$ in the equation:

$$S_{if}=(C_s/C_{if})\cdot(V_t-V_2/V_2)$$

where $S_{if}$=immobile fluid saturation, fraction of reservoir pore volume;

$C_s$=the amount of immobile fluid per unit volume of sweep fluid when said sweep fluid is saturated with said immobile fluid at reservoir temperature and pressure;

$C_{if}$=the amount of immobile fluid per unit volume of immobile fluid at reservoir temperature and pressure;

$V_t$=the total volume of sweep fluid injected; and $V_2$=the second fluid volume.

2. The method of claim 1 wherein said immobile fluid is natural gas.

3. The method of claim 1 wherein said sweep fluid is aqueous.

4. The method of claim 1 wherein said immobile fluid is aqueous.

5. The method of claim 4 wherein said sweep fluid is a gas.

6. The method of claim 1 wherein said sweep fluid contains a tracer.

7. The method of claim 1 wherein the value of $V_2$ is that volume at which the concentration of said immobile fluid approximately equals $C_s/2$.

* * * * *

UNITED STATES PATENT AND TRADEMARK OFFICE

CERTIFICATE OF CORRECTION

PATENT NO. : 4,158,957

DATED : June 26, 1979

INVENTOR(S) : Harry A. Deans and James R. Bragg

It is certified that error appears in the above-identified patent and that said Letters Patent is hereby corrected as shown below:

At column 4, line 15, that portion of the equation reading:

"$(V_t - V_2/V_2)$" should read -- $\frac{V_t - V_2}{V_2}$ --.

At column 4, line 20, delete "$C_2$" and insert -- $C_S$ --.

At column 6, line 37, that portion of the equation reading:

"$(V_1 - V_2/V_2)$" should read -- $\frac{V_1 - V_2}{V_2}$ --.

At column 10, line 42, that portion of the equation reading:

"$(V_t - V_2/V_2)$" should read -- $\frac{V_t - V_2}{V_2}$ --.

Signed and Sealed this

Thirty-first Day of July, 1990

*Attest:*

*Attesting Officer*

HARRY F. MANBECK, JR.

*Commissioner of Patents and Trademarks*